United States Patent [19]

Ducloux

[11] Patent Number: 4,479,582

[45] Date of Patent: Oct. 30, 1984

[54] SORTING DEVICE FOR SORTING CONVEYED OBJECTS

[75] Inventor: Marcel Ducloux, Carrieres Sur Seine, France

[73] Assignee: Saint-Gobain Emballage, France

[21] Appl. No.: 457,213

[22] Filed: Jan. 11, 1983

[30] Foreign Application Priority Data

Jan. 15, 1982 [FR] France ..... 82 00603

[51] Int. Cl.[3] ..... B07C 5/02

[52] U.S. Cl. ..... 209/552; 209/651; 209/654; 198/367; 198/437

[58] Field of Search ..... 209/651–654, 209/524, 552, 523, 561, 656, 560, 919, 925; 198/367, 370, 437, 441

[56] References Cited

U.S. PATENT DOCUMENTS 2,723,748 11/1955 Simpson ..... 209/652 X
2,919,801 1/1960 Pechy ..... 209/561 X
3,687,285 8/1972 Messervey .
4,020,950 5/1977 Williams ..... 198/441 X

FOREIGN PATENT DOCUMENTS 2347563 3/1975 Fed. Rep. of Germany .
2936988 3/1981 Fed. Rep. of Germany .
2119490 7/1972 France .

*Primary Examiner*—Robert B. Reeves
*Assistant Examiner*—Glenn Foster
*Attorney, Agent, or Firm*—Pennie & Edmonds

[57] ABSTRACT

Apparatus for use in an industrial operation wherein objects moving along a main path from an upstream to a downstream location are diverted to a second path for checking. The apparatus comprises an ejecting wheel for sorting objects which shall have been checked defective for some reason and preventing movement of those objects from returning to the main path.

9 Claims, 7 Drawing Figures

1
2
3
4
5
6
7
8
9a
9b
10
11
12a
12b
13a
14a
15a
16a
17a
18
19
28
28a
28b
28'
29
38
C
D
E 10
9b
9a
28
4
28a
9b
29
1
28b
9a
1
39b
34a
39a
34b
20a
3
18
5
25
15b
11
16b
31
41a
19
15a
32
16a
42a
12a
13a
17a
17b
35a

SORTING DEVICE FOR SORTING CONVEYED OBJECTS

DESCRIPTION

Technical Field

The invention relates to apparatus for use in an industrial operation for sorting or segregating objects moving along a main path between an upstream and downstream location, and operative in removal from the main path of objects which for some reason fail to meet a checking criteria. The apparatus is particularly useful in handling and sorting or segregating bottles, jars and similar glass containers.

Background of the Invention

In many industrial operations during the movement of objects along a conveyor from an upstream location, it is desirable to subject those objects to visual test or test by automatic testor sensing means including optical, mechanical and/or electrical sensors and to remove each object from the stream of objects moving seriatim that fail to meet the checking criteria. Typically, the objects which may be bottles, jars and other glass containers are moved along a conveyor at a high rate of speed. Movement at a high rate of speed normally is required in bottling operations utilizing automatic machines during which the bottles may be filled and capped, and packaged, for example. These operations oftentimes require that the bottle be checked or sensed as to its physical integrity, the manner of filling, capping, and so forth to assure that bottles received at any downstream operative station whether that station is for packaging and transit to the marketplace or otherwise meet a standard.

In the prior art it is typical that objects such as those previously described moving seriatim are routed differently as a function of a response of a sensor to some sensed condition and many instrumentalities have been used in removing objects from a line. To this end, the prior art includes forms of ejector apparatus located at a fixed position along a conveyor path. The ejector apparatus may be activated by a signal or signals generated by an automatic sensor or following visual sensing. These ejector apparatus include a pushrod under control of a cylinder, such as a pneumatic cylinder movable generally crosswise of the conveyor. Movement of the pushrod typically will be with a stroke on the order of the width or diameter of the object. The ejector apparatus may also include a nozzle having an opening directed generally crosswise of the conveyor emitting a blast or jet of air as each object to be removed from the stream passes the fixed position. This type of ejector apparatus has found use with objects that are relatively light in weight.

The apparatus as described provide the advantage of simplicity of design and ease in adaptation to manufacturing changes. However, the ejector apparatus suffer from the disadvantage that they are not accommodated to operation on objects of all types. Further, the ejector apparatus, particularly the ejector apparatus including a movable pushrod which must operate at a high rate of speed in concert with the movement of objects oftentimes operates with too violent an operation. A violent operation is to be avoided because the object as sorted or segregated may be reclaimed for some reason.

German Auslegeschrift No. 23 47 563 discloses ejector apparatus generally of the type including a movable pushrod. Particularly, the publication discloses the combination of a pushrod and a guide and retention element for bottles moving along conveyor path. The retention element is formed by a wheel including a plurality of pockets locked by an elastic jaw. The pushrod may operate in a manner to engage a bottle and move it into a pocket so that the bottle is extracted from the wheel at an angular location different from that at which other objects are extracted. The bottle that is engaged by the pushrod is one which shall have failed to meet some criteria and is to be sorted or segregated from other bottles. This ejector apparatus suffers from a disadvantage previously discussed, namely that the action of the pushrod is extremely rough, particularly during operation at a very high rate.

It has also been suggested that the ejector apparatus may include a pushrod for movement of objects toward an elastic auxiliary wheel. In this operation the pushrod may exert force on the object over a sufficient time interval that the object not only moves from the path along which it is conveyed but also engages with the auxiliary wheel for movement with the auxiliary wheel. Finally, the object is diverted to a secondary path for removal from the flow of objects. While, in ejector apparatus of this type, the stroke or travel of the pushrod may be reduced, and the action of the pushrod may be both positive and more gentle in nature, use of the ejector apparatus still is limited.

Because of limitations in operation of prior art ejector apparatus, particularly when used in concert with conveyors along which objects subject to checking are moved rapidly, the industry has moved toward use of apparatus somewhat akin to the apparatus described in the aforementioned publication. Thus, the apparatus includes a plurality of pockets within which an object is received and jaws or suction cups associated with each pocket for grasping the object. Each jaw or suction cup is individually controlled to release its object if it meets the criteria which may be optically checked at one angular location and to release its object at another angular location if it fails to meet the criteria. Thus, the respective objects which are moved from an upstream conveyor along an angular path are optically checked during movement and released to a proper downstream conveyor. While these conveyor machines are able to operate a high rate of speed, they suffer from the disadvantages of complexity of design and an inability to adapt readily to manufacturing changes in the shape or size of the objects to be tested since the sockets including the jaws or suction cups are designed for an established angular pitch and an established size and shape of object. In addition to cost and the lack of flexibility of use, these checking apparatuses are relatively delicate to both maintain and operate.

The prior art also includes ejector apparatus that travels with or accompanies the objects along a path of movement. This ejector apparatus is placed alongside the conveyor, downstream of a sensor at a checking station. Generally, the ejector apparatus comprises an endless belt which carries a plurality of pushrods. Each pushrod is adapted to act upon an object which is sensed as failing to meet prescribed criteria. Thus, upon receipt of a defect signal the pushrod is operative to push on the object in a progressive way and move the object from the conveyor in the direction of a bypass thereby to relocate the object on an auxiliary conveyor.

Ejector apparatus of the type last-mentioned are somewhat less complicated when compared in design and operation with other ejector apparatus of the prior art, and the ejector apparatus has the further advantage that it is capable of operation at a relatively high rate of speed. Further, the ejector apparatus may be used advantageously in sorting or segregating objects, such as bottles moving along a bottling line. In this operation, however, it is required to maintain the bottles to be sorted or segregated at some relationship of spacing. This is important since the bottles move along a path spaced relative to the pushrod belt and improper spacing may affect the sorting or segregation operation. Thus, it is important to avoid a lag in spacing of bottles as may result from slippage of bottles on the conveyor, and also to avoid a close grouping of bottles as may result from a stoppage or pileup of bottles at a downstream location.

German Offenlegungsschrift No. 2,936,988 discloses a further approach in the prior art. This publication describes an ejector apparatus having an ejection device which works with a star wheel to locate objects, described as bottles, to one of two conveyor paths as determined by a sensor at a checking station. The ejection device is in the form of an ejecting wheel rotatable about a vertical shaft in movement synchronized to that of the star wheel mounted opposite to it. The ejecting wheel, further, is provided with a series of ejecting pins. The ejecting pins are supported on vertical shafts at their upstream part, with a pitch corresponding to that of ejecting wheel. The pins are applied against their surface to maintain contact with the star wheel to eject bottles.

It has been found difficult to guide each bottle as ejected over a sufficient distance to divert the bottle from the normal course either without pin contact with a following bottle or an angular deflection of excessive nature thereby leading to variable sliding of the bottle. Both factors are factors of instability of operation. The outside face of each pin must be concave in shape, and the end of the pin provides the working area. The structure of pins militate against close spacing thereby to provide for use of the ejector apparatus in the ejection of bottles characterized as "small-size" that is, bottles having a diameter of less than about 50 to 60 mm.

Summary of the Invention

The invention provides an improvement over the prior art both in the manner of operation of the ejector apparatus or sorting device and in the compactness of its structure.

In a general aspect, the sorting device includes a wheel movable about a vertical axis. The axis of the ejecting wheel is parallel to the axis about which a distributing wheel of the type characterized as a "star wheel" including a plurality of pockets at a prescribed pitch is capable of movement. The wheels are spaced at a distance so that an object within the respective pockets of the distributing wheel and moving with the distributing wheel is not impeded in movement by the ejecting wheel. Preferably, the outside diameter of the ejecting wheel will be about one-third to about one-half of the diameter of a circle defining a path of movement of objects following movement of the distributing wheel.

The ejecting wheel may, itself, be a star wheel synchronized to the movement of the distributing wheel. It may provide a smooth outer surface, as well, if limited sliding movement of objects between the wheels may be permitted. An ejecting wheel having a smooth outer periphery has the advantage that there need be no concern with pitch of teeth of a star wheel under circumstances that the pitch of teeth of the distributing wheel is changed because of a change in manufacturing.

If the ejecting wheel is a star wheel the teeth forming the pockets will have a pitch as required by the distributing wheel. On the other hand, when the industrial operation is being carried out at a high operating speed, the speed of movement of the ejecting wheel is independently synchronized to the movement of the distributing wheel. A mechanical transmission or an electronic synchronization device, or some similar manner of synchronization may be employed.

A plurality of pins are carried by the ejecting wheel. The pins are passive elements having an elongated arcuate outer surface providing a bearing surface residing, at rest, within the outer periphery (which may be the periphery at the base of the pocket) of the ejecting wheel. Each pin is mounted on a shaft positioned parallel to the axis about which the ejecting wheel rotates and extends in an upstream direction, that is, in the direction from which objects move. According to this mounting attitude, the pins, when they are deployed in the sorting of objects, move into contact with the object, such as a bottle and act upon the bottle progressively by a rolling movement along its surface. The contact is substantially without impact.

In a preferred form of the invention the pins are arranged in two families of pins along the ejecting wheel with one family being located above the other, and the pins in one family being staggered or overlapped in relation to the pins of the other family.

The pins are subjected to a constant thrust outwardly toward the circle defining the path of movement of the bottles. Thrust may be applied by a spring or similar elastic means.

Each pin may be deployed by release of a catch or some other instrumentality which shall maintain the pin at rest. To this end, a cylinder may be actuated by an eject signal to deploy a specific pin thereby to sort a bottle that shall have been sensed as failing to meet certain criteria in passage along a second path of movement of bottles. Deployment of a pin results in the bottle not being released from its pocket in the distributing wheel until the bottle has moved angularly beyond the position from which bottles normally exit the distributing wheel to the main path of movement. The bottle that is sorted, then, moves toward an auxiliary path of movement.

The pins as deployed are returned to their at rest position following contact action with a bottle to commence a second and subsequent cycle of operation as the ejecting wheel continues in rotation. The return action may be carried out by a cam and/or reset roller acting along the arcuate outer surface of the pin to progressively rotate the pin, against the spring force, to a position of readiness or a catch position for subsequent deployment.

A detailed description of preferred embodiments of the invention is set out below.

BEST MODE FOR CARRYING OUT THE INVENTION

Figure 1:
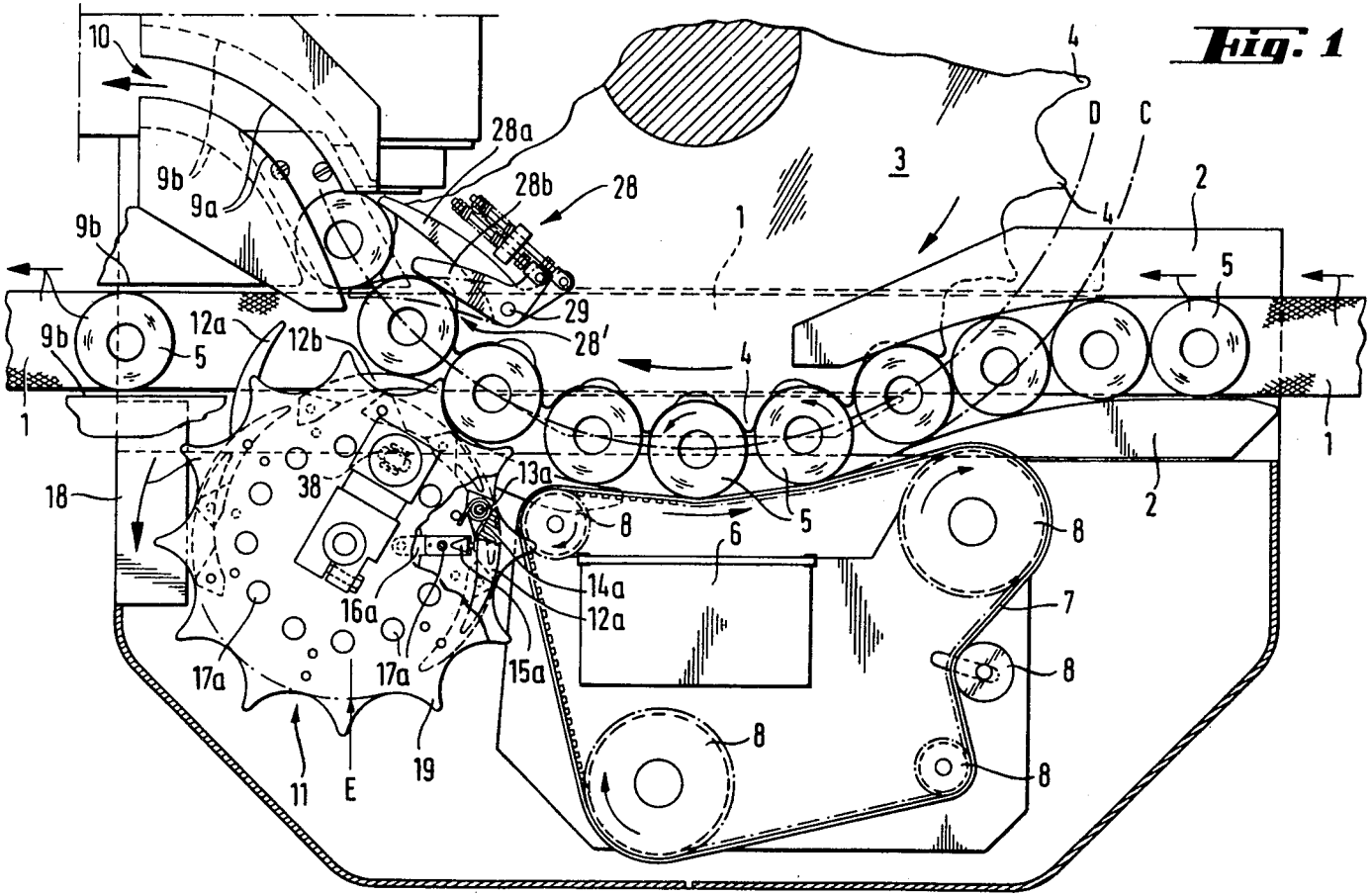
FIG. 1 is a top diagrammatic view of a portion of industrial operation including a conveyor path and the ejector apparatus of the invention.

A portion of an industrial operation is illustrated in FIG. 1. The operation includes a conveyor 1 for moving objects along a main path in the direction of the arrows from an upstream to a downstream location (right to left in the Figure), and a second path along which the objects are checked for certain criteria including a defect in manufacturing, an improper volume of fill of a container, for example. The conveyor, illustrated only in a very general fashion, may be of any type commonly used in the movement of objects along a longitudinal, horizontal path. Thus, the conveyor may be a belt or platforms, supported at locations along their run. The conveyor may be driven in any manner and by any conventional means. Neither the support nor the drive is shown since structure of this type is well known in the art.

Conveyor 1 provides a path of movement for objects both toward and away from the second path and both a checking station and a sorting device located therealong. The sorting device is located at the downstream end of the second path, at the junction with the main path and functions to sort or segregate objects from return to the main path and to move those objects to a shunt path. In this operation, the sorting device is controlled by the checking device located at an upstream location along the second path. To this end, a signal is generated by the checking device for each object that is sensed as failing to meet certain criteria and that signal is used to activate the sorting device.

The sorting device is particularly adapted for sorting objects such as bottles, jars and other glass vessels having a trunk or base and a neck portion. These objects will hereafter be referred to as containers.

As illustrated in FIG. 1, containers 5 are formed with a trunk or base and a neck extending from an arcuate transition portion. The containers move with conveyor 1 in an upright orientation and in positions of contact with the container immediately ahead and immediately behind. The positional relationship of the containers along the conveyor is of no concern, although as also illustrated in FIG. 1, the containers are spaced in movement along the second path.

A guide 2 is located laterally of the conveyor. The guide includes a pair of walls, spaced apart by a distance somewhat greater than the dimension of the container at its base. Each wall follows a smoothly arcuate path to progressively guide the containers from the main path to the second path. The guide may be of any construction, such as a narrow rail and, in a manner similar to other structural components of the apparatus, supported by a framework (not shown). A distributing wheel 3 including a turret and a pair of superposed plates is disposed adjacent both the main path and the second path. Each of the superposed plates may be keyed or otherwise secured to the turret or otherwise driven about the turret for moving the containers 5 along the second path. To this end, the superposed plates are coextensive in outline including a plurality of outwardly extending teeth 4 providing a series of pockets. The teeth are located at a constant pitch, and containers moving along guide 2 are picked up one by one in the individual pockets. The superposed plates are spaced apart by a small distance so that the containers are supported in movement at two locations along their base. The containers move along the second path which is denoted as the circle D.

A belt 7 is movable along a portion of the second path within the region substantially between the guide 2 and the sorting device, for supporting the containers 5 within the individual pockets. The belt is supported by a plurality of pulley wheels 8 for movement in an endless path in a direction opposite to the direction of movement of the containers. The belt need not be of any great width and preferably it will move along a run at a height relative to the container between the superposed plates of distributing wheel 3. The belt preferably is formed of a material that will not slide along the surface of the container during movement, but rather frictionally grip each container during movement to cause the containers to rotate about their axes (see FIG. 1). The belt may be formed of a resilient material such as rubber or a conventional rubber substitute. The belt may be adjusted to follow along the diameter of the circle C following the contact run. Adjustment may be varied to accommodate containers of different diameters. Each one of pulley wheels 8 may be driven. The speed of the drive will be chosen so that each container supported by the belt will undergo at least a full revolution within the pocket when presented to a checking station 6, illustrated only generally in FIG. 1.

In a preferred embodiment of the invention, the diameter of circle C may be about 750 mm and the distributing wheel includes a plurality of twenty-four pockets, each at an angular spacing of 15°.

The sorting device 11 is located at the downstream end of the second path and, as discussed, functions to either permit return of an individual container 5 to the main path or to prevent return of an individual container to the main path and conveyor 1. The operation will be fully set out below but generally each container at the downstream end of the second path is guided either to conveyor 1 and the main path or to a system of guides 9*a* and 9*b* for stabilization of the containers in movement toward a shunt 10, and discharge from the industrial operation. Movement of each container to the main path is controlled by the distributing wheel and movement of each container to the system of guides is controlled by the sorting device. Structurally the guides 9*a*, 9*b* may duplicate the guide 2. Thus, the guide 9*a* comprises a pair of walls spaced apart by a distance somewhat greater than the dimension of the neck of the container and the guide 9*b* includes a pair of walls spaced apart by a dimension somewhat greater than the dimension of the base of the container. A line of movement, along the guides follows a smooth arcuate path to the shunt path 10. The shunt path may include a conveyor like conveyor 1. A portion of guide 9*b* extends along conveyor 1 and along the second path for purposes of guiding the containers when returned to the conveyor path for movement to a downstream location and along circle C between the belt 7 and sorting device 11.

Figure 2:
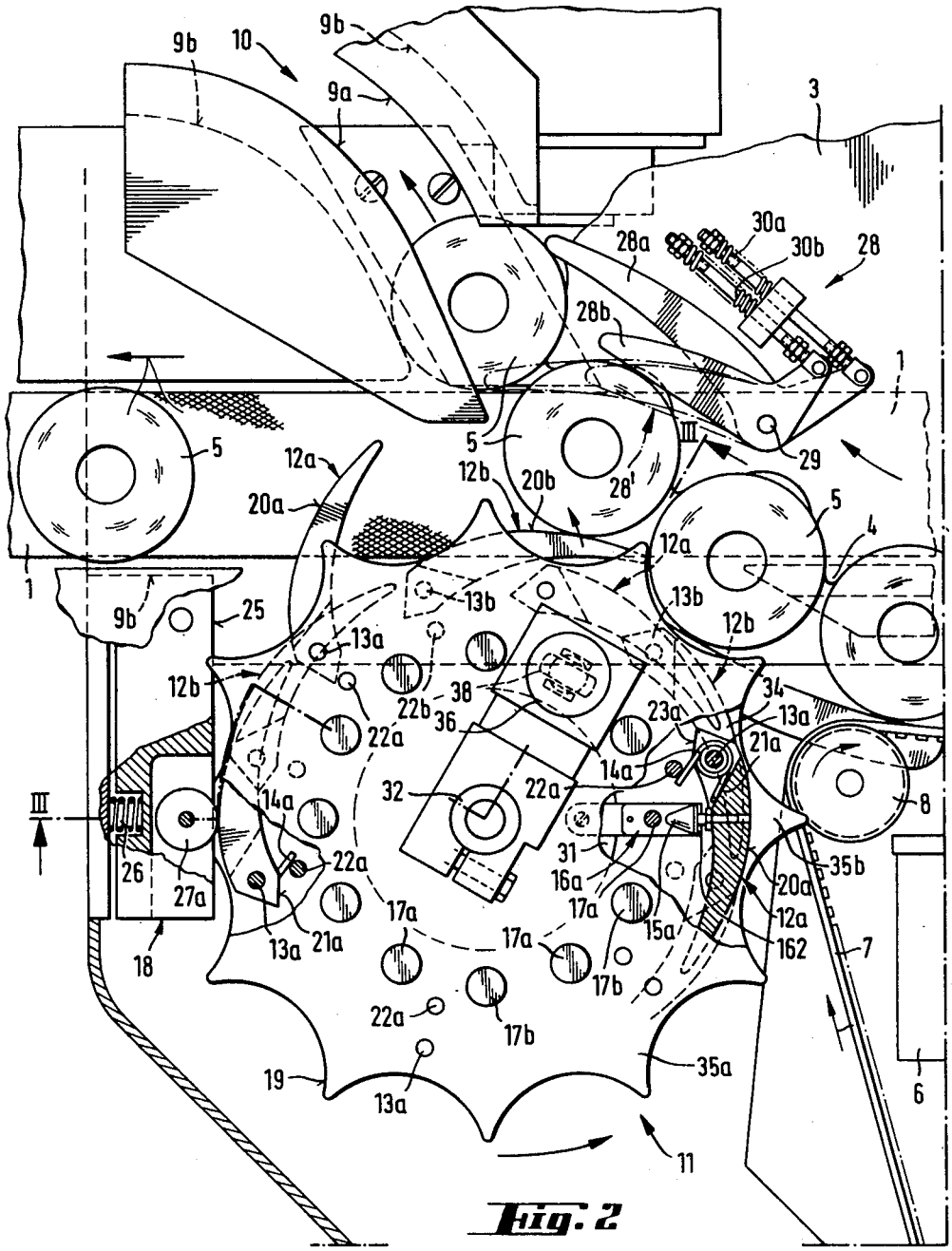
FIG. 2 is a view like that of FIG. 1 illustrating a portion of the industrial operation on a larger scale.
Figures 3, 4:
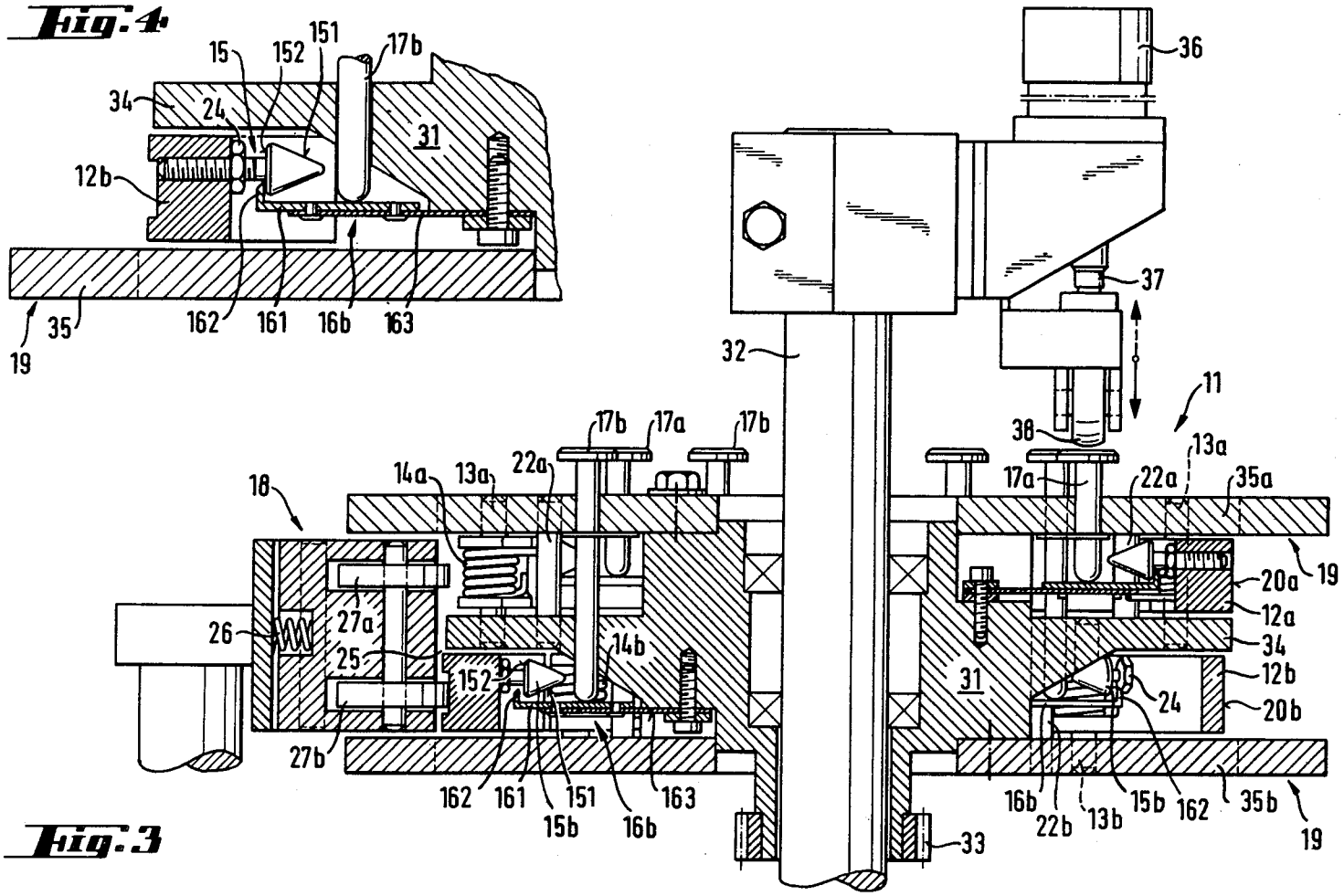
FIG. 3, again on a larger scale, is a view in section as seen along the line III—III in FIG. 2.
FIG. 4 is an enlarged detail of a portion of the structure illustrated in FIG. 3.

The sorting device 11 comprises an ejecting wheel illustrated in FIGS. 1–3. Referring to FIG. 3, the ejecting wheel is formed by a hub 31, a disc 34 in the form of an integral, annular flange extending substantially from the mid-region of the hub, and a pair of superposed flanges 35*a*, 35*b*. The flanges are supported by the hub at positions of substantially equidistant spacing from the disc. The hub includes a central bore and is formed with a collar. A shaft 32 or turret extends through the bore and collar, and the hub is supported for rotation by a pair of spaced bearings. A pinion 33 is press fit or otherwise received on the collar. The pinion comprises a part of a drive train and the ejecting wheel is driven by a transmission (not shown). The form of the sorting device, as described, generally corresponds to the distributing wheel already described as including a turret and superposed plates. The ejecting wheel of the sorting device 11, however, may be of a construction wherein the outer periphery (defined by circle E) is smooth or of star-shaped outline like that of the distributing wheel 3. The Figures illustrate the latter construction wherein a plurality of teeth 19 extend outwardly of the circle E. The teeth define a plurality of pockets, the base of which are tangent to circle E. The choice of construction of ejecting wheel may be based upon a consideration of whether containers may be allowed to slide along the passage between the ejecting and distributing wheels. If it is possible to allow for sliding of containers along the passage, the pitch of the teeth 4 of distributing wheel 3 may be reduced and the number of pockets in the distributing wheel may be increased for example, to thirty pockets without requiring any change in construction of the ejecting wheel. However, it would be necessary to increase the angular speed of the ejecting wheel so that the ejecting and distributing wheels remain synchronized in rotation. If, however, sliding movement of containers within the passage is to be avoided, preferably an ejecting wheel of star-shaped outline would be used. In any event, an ejecting wheel of star-shaped outline may be preferred under circumstances of construction and orientation of structure wherein the longitudinal axis of the main path and conveyor 1, relative to the path of movement of containers along circle D at the downstream end of the second path, is at a sharp acute angle such as the acute angle illustrated in FIG. 1.

Under the circumstances that the distributing wheel 3 and ejecting wheel 11 are both of star-shaped outline, and although the teeth of the two wheels mesh to an extent, of the containers within the pockets, it still is useful to assure proper synchronization of the angular speed of the ejecting wheel with that of the distributing wheel. In practice, synchronization of the two wheel is assured by a separate input drive for the ejecting wheel. A separate input drive will allow the maintenance of a high operating rate, and the separate input drive will avoid any hitch in case of interruption of power to the apparatus.

Referring again to FIGS. 1 and 2, a plurality of pins are carried by the ejecting wheel. The number of pins is determined by various factors including the number of pockets in the distributing wheel, the angular speed of movement of both the distributing and ejecting wheels, and so forth. If the distributing wheel includes the number of pockets heretofore discussed, namely twenty-four or thirty pockets, then the ejecting wheel may support a plurality of twelve pins and rotate at an angular speed twice, or two and one-half times that of the angular speed of rotation of the distributing wheel so that a pin is presented in a proper orientation to act upon a container as each and every container moves to that orientation. The axis of the ejecting wheel, as illustrated, is located outwardly of circle D by a distance approximately equal to one-half the length of the radius of the circle.

The specifics of the mounting of the pins and their manner of operation will be discussed below, but generally the pins are mounted in a pair of families of pins 12*a* and 12*b* and in an arrangement whereby the successive pins of the two families of pins function in the sorting of every other container in its movement within the downstream end of the second path. The family of pins 12*a* are located at positions of 60° spacing above disc 34 and the family of pins 12*b* are similarly located below disc 34 whereby all of the pins are staggered among themselves at positions of 30° spacing. While there are two families of pins 12*a*, 12*b* and, similarly, families of structure specifically directed to one family of pins or the other which carry the same suffix, the discussion to follow will be set out without specific suffix identification. To this end, the discussion is believed to adequately describe the apparatus and should be considered as encompassing all structure.

A pin 12 is supported on a shaft 13. The pin is of an elongated outline extending from an enlarged end at the point of support to a tip. The outer surface (the surface toward the distributing wheel) is contoured and the pin normally is retained in a position relative to the ejecting wheel that the contoured surface is tangent both to the circle C and the circle E. A spring 14 or some other biasing instrumentality is mounted by the ejecting wheel. The spring may be carried about the shaft and may act between the pin 12 and a fixed pin 22, thereby to exert a force tending to cause movement of the pin about a shaft 3. The pin, however, carries a lug 15 which interacts with a pawl 16 to prevent movement of the pin from the retracted position within the confines of circle E. A pushrod 17, controlled in operation by checking station 6, is adapted to be actuated as each container 5 which is to be sorted or segregated from other containers in movement to the main path enters the passage between the ejecting wheel and distributing wheel. The pushrod functions to release pawl 16 so that the pin 12 may be deployed in movement outwardly of circle E into contact with the container. As will be discussed, pin 12, then, progressively forces the container toward the system of guides 9*a*, 9*b*. That container (see FIGS. 1 and 2) then moves to shunt path 10. The pin that was deployed is reset within the confines of circle E as the ejecting wheel rotates relative to a reset element 18.

Referring to FIG 2, it may be seen perhaps to best advantage that pins 12 are of a length on the order of at least one and one-half times the diameter of the containers 5. The contour in the outer surface of the pins provides a bearing surface 20 facing the distributing wheel 3 having a center of curvature less than that of circle E. As indicated, each pin in biased for deployment in the direction of movement of ejecting wheel 11. When deployed under the force exerted by spring 14 the bearing surface 20 will move into contact with a container 5. The curved surface provides increased bearing contact. The pin will continue in movement in deployment until a surface 21 at the enlarged end of the pin contacts the pin 22.

In operation, containers are guided to the second path for movement along circle D. The containers are checked at a checking station 6 and sensed as either meeting or failing to meet certain criteria. If a container meets the criteria it is allowed to return to conveyor 1 and the main path at the downstream end of the second path, but if the container fails to meet the criteria it is prevented in ret urn to the main path.

In addition to the pins 12, the apparatus also includes a semipositive switch 28. The semipositive switch (hereafter "switch") is formed of a pair of bell-crank elements, each supported for movement independently about a shaft 29. Each bell-crank element includes a leg which is longer than the other leg, illustrated as leg 28*a*, 28*b*. The legs, referring to FIGS. 1 and 2, are biased in the counterclockwise direction toward the second path. It is the function of both legs to move or tend to move a container 5 into the main path from its pocket in distributing wheel 3. A rod is attached pivotally to each of the shorter legs of each bell-crank element, and a spring 30 under compression is disposed between the end of the rod and support through which the rod extends.

Additionally, the leg 28*a* is of a length to extend beyond the leg 28*b* to act on containers after further downstream movement and for overall independent movement.

The amount of the force exerted on each leg may be adjusted by adjustment of the compressive force of each spring; the compressive force exerted on legs 28 however, will be less than the force of spring 14 acting on a pin 12 so that under circumstances that a container is to be sorted or segregated from the main path, the force in deployment of the pin will overcome the force acting on each leg 28*a*, 28*b*.

Thus, these legs normally deployed to the position 28' (see the dot-dash line in FIG. 1), will be forced to rotate through a clockwise angle of rotation as the pin 12 deploys and causes movement of a container toward the system of guides 9*a*, 9*b*.

Figure 5:
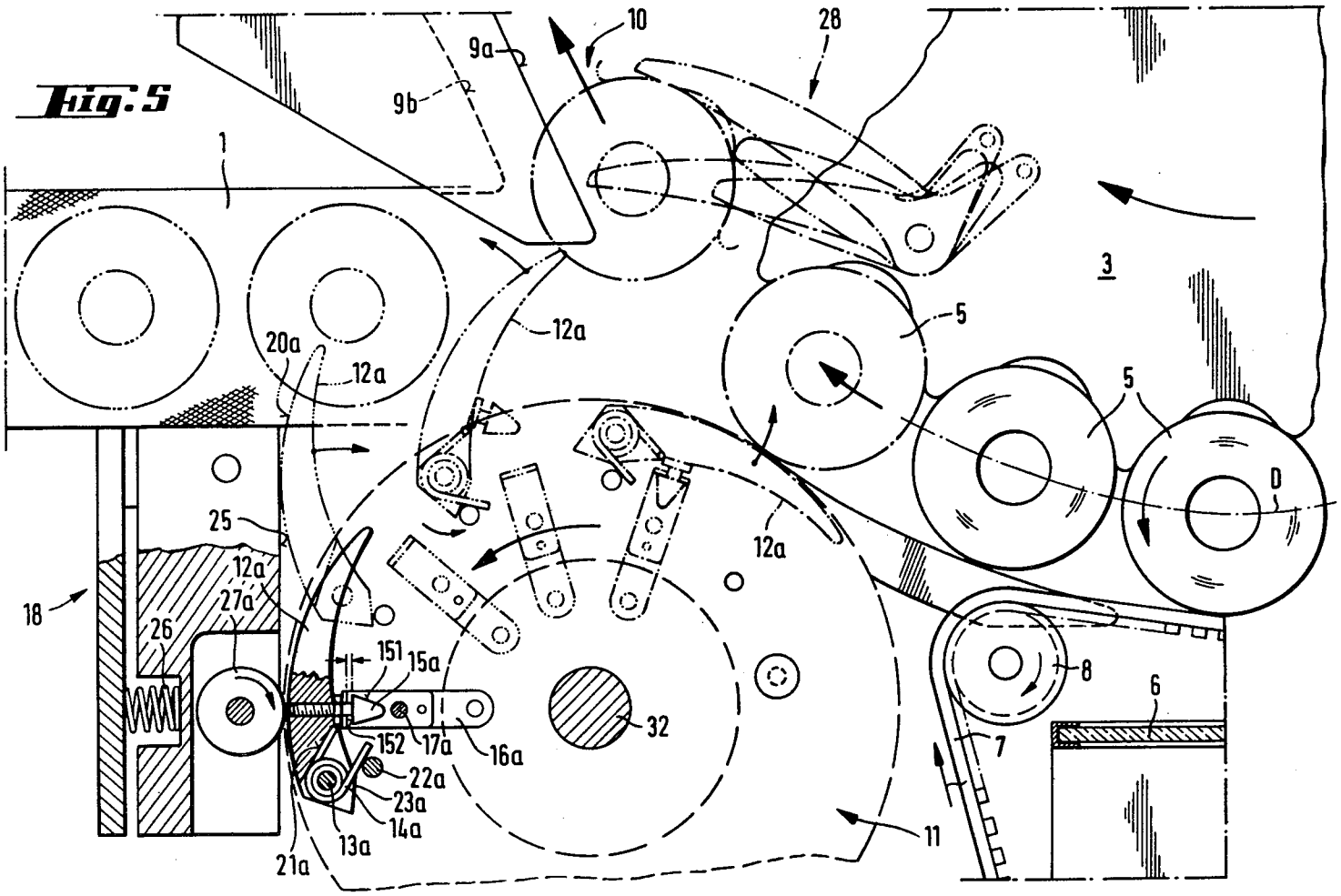
FIG. 5 is a top diagrammatic view similar to FIG. 2, but further enlarged, illustrating successive operating phases of an ejecting pin.

The operation may be seen in FIG. 5. To this end, containers 5 moving along circle D through the checking station 6, and rotating in movement by belt 7, enter into the passage between the ejecting wheel 11 and distributing wheel 3. The initial length of passage before the region between the distributing wheel and the ejecting wheel is defined by a portion of guide 9*b* having a surface concentric to the circle D along the circle C. The guide extends to a position of tangency with the ejecting wheel along the periphery of circle E wich may be smooth or which may include the outer star-shaped outline. Full movement, therereafter through the passage will comprise movement between the ejecting wheel and distributing wheel to the end of the second path.

Under circumstances that a container is to be sorted or segregated from the main path, a pin 12 will release and commence movement through an angle of rotation as indicated by the arrow. The force imparting movement to pin 12 is of a magnitude sufficient to overcome the force acting upon legs 28 so that the latter retract form the position 28', that is, the legs successively move in the clockwise direction against the biasing force acting on them. While the leg 28*a* of switch 28 still allows the container 5 to be forced to the path defined by the system of guides 9*a*, 9*b* in movement of the container toward shunt path 10, the leg 28*b* comes back and functions to locate the next container to conveyor 1, if another pin 12 is not released due to a new signal.

Thus, pin 12 prevents the container from moving out of the pocket in the distributing wheel 3. The container then follows the path of movement along circle D toward the system of guides 9*a*, 9*b* and shunt path 10. The tooth of the distributing wheel behind the container continues to impart movement to the container and the tooth and pin direct that movement toward the system of guides. At the point of release from the container, the pin will complete its movement as limited by interaction of bearing surface 21 and pin 22. A former container on conveyor 1 will have moved sufficiently in the downstream direction so that it is not struck by pin 12.

The reset device 18 includes a surface 25 for relocating the pin 12 to the retracted position with the circle E. The surface acts as a cam which bears against the bearing surface 20 of the pin to impart movement to the pin as the ejecting wheel rotates. The pin moves in the direction of the arrow. The surface 25 may be a continuous surface to confront pins in both families of pins or a pair of surfaces in the path of movement of the pins of each family. A roller 27 or pair of rollers 27*a*, 27*b* are carried by the reset device. These rollers, respectively, act upon the pins to cause a final angular rotation and final movement to the retracted position. The rollers are supported within a opening of the housing of the reset device and a spring 26 may be employed to bias at least the roller toward the pins.

Under circumstances that a container is sensed as meeting the criteria, the legs 28 serve to impart movement to the container in a direction toward the ejecting wheel so that the container follows movement of that wheel. This movement will be along a path concentric with the circle E either within a pocket of the ejecting wheel or in residence against the periphery of the ejecting wheel. More particularly, the legs 28 will cause the container to exit a pocket in the distributing wheel to act with conveyor 1 against forward inertia along the path of circle D to enter through a gate formed by ejecting wheel 11 and a wall of guide 9*a*. The container, then, will move in the direction of the arrow along the main path.

Referring again to FIG. 3, the pins 12*a* are mounted between the flange 35*a* and disc 34, and the pins 12*b* are mounted between the flange 35*b* and disc 34. Accordingly, the structure for mounting the pins, the structure for biasing the pins, the structure for limiting movement of the pins including, for example, the shafts 13, springs 14 and fixed pins 22 will be similarly mounted.

Referring to FIG. 4, a lug 15 is carried by each pin 12. The lug includes a head 151 extending from a shank which is threaded into a bore tapped in the inner surface of the pin. The lug is adjustable in length as determined by the position of locking of a lock nut 24. The head has a conical surface toward the axis of rotation of the ejecting wheel and a shoulder 152 at the base of the head. From the construction of the ejecting wheel, as set out above, there is an opening within the hub 31 above and below the disc 34. A series of pawls 16, one for each pin of each of the families of pins, extend into the opening. The pawls include a plate 161 having a finger 162 at the end for purposes of engagement behind the shoulder 152 when the pin is in the retracted position within the confines of circle E. The plate is mounted on a spring blade 163 which, in turn, is mounted to the hub by a machine screw or the equivalent. The normal position of the structure is as illustrated in FIG. 4 whereby the spring blade maintains the plate in position to latch, by shoulder 152 and finger 162, the pin. A pushrod 17, acting on the plate when moved in a downward direction, toward flange 35*b*, will unlatch the pin which will deploy in the manner previously described. A series of pushrods are disposed in cooperative relation with each pin of each family of pins.

A responsive mechanism 36, that is, a mechanism responsive to a signal from checking station 6, is supported on shaft 32. The mechanism may be a cylinder under the control of an hydraulic or pneumatic system having a rod 37 movable in the directions of movement indicated by the arrow (FIG. 3). A roller 38 preferably is attached to the rod for purposes of rolling along a head of a pushrod 17 when the cylinder is actuated to move rod 37 toward and into engagement with the pushrod. Thus, as the ejecting wheel moves relative to the cylinder, a signal from the checking station, with appropriate time lag, will result in movement of rod 37. The rod 17 will follow that movement and a pin 12 will be deployed. The cylinder is capable of repeated actuation in synchronism with movement of the ejecting wheel and containers moving along circle D so that each and every container that is to be sorted or segregated from the main path will be located by a pin to the system of guides 9*a*, 9*b*.

The downward movement of rod 37 is rapid and the stroke through which the rod moves will be sufficient to release the finger 162. The finger, then, follows the conical surface of head 151 of the lug 15 in return to their rest position of FIG. 4. The cylinder, preferably, is a double-action pneumatic cylinder.

When the ejecting wheel has rotated sufficiently so that the bearing surface 20 of the deployed pin moves along cam surface 25, the conical head 151 of lug 15 begins to move along finger 162 to bias plate 161 toward flange 35*b* (see FIG. 4). Movement of the bearing surface along cam 25 and ultimately along the roller 27 results in complete retraction of the pin, and movement of shoulder 152 beyond the finger 162. When the bearing surface moves angularly beyond the roller, the pin will move slightly outward to the at rest position. In this position the finger will engage in back of the shoulder to restrain movement as urged by spring 14.

As illustrated in FIG. 5, the pin will have several attitudes in operation including a retracted attitude (the dotted line position at about one o'clock) from which it exerts a progressive action along its bearing surface 20 upon the body of a container to hold the container in a socket of the distributing wheel 3; an attitude at which the pin having escaped the body of the container is at a stop position at which a bearing surface 23 engages fixed pin 22; and attitudes of position along cam 25 and roller 27 in the return of the pin to the at rest (full line position in the Figure).

Figure 6:
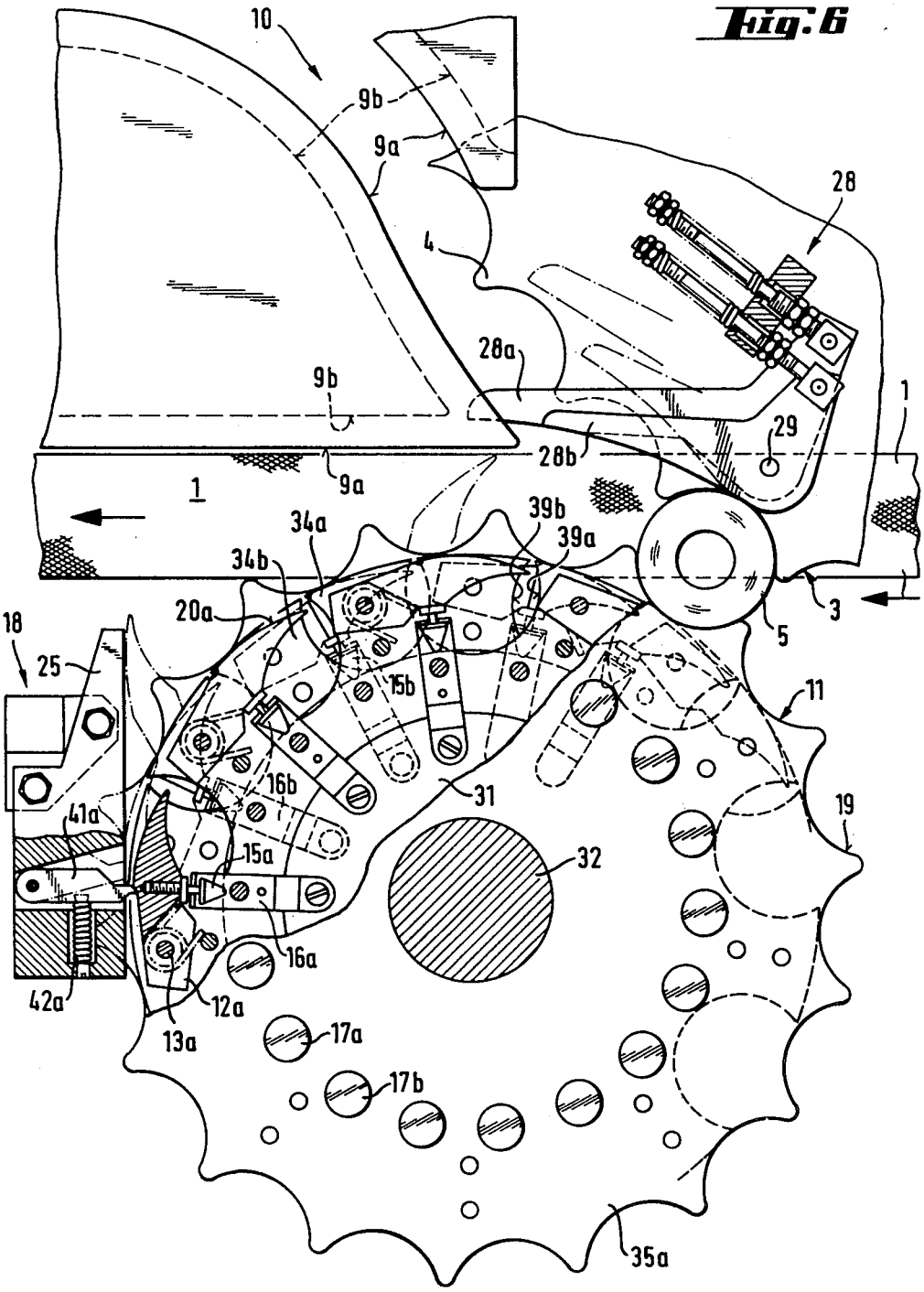
FIG. 6 is a view similar to FIG. 2 of ejector apparatus for ejection of small-size bottles.

The apparatus of FIG. 6 duplicates generally the apparatus already described and has utility specifically sorting or segregating containers of small-size which may be moved at a high rate of speed. Structure of similar nature and function is identified with like numeric identification in the Figure.

The apparatus of FIG. 6 includes a distributing wheel 3 having an outer diameter of a dimension like that of FIG. 1 and a plurality of thirty-six pockets. The ejecting wheel of sorting device 11 having a circle E is smaller and more compact than the ejecting wheel of FIG. 1. The ejecting wheel carries a plurality of eighteen pins 12 and is synchronized in movement mechanically to that of the distributing wheel for rotation at twice the speed. In this manner, it is possible to locate a pin in position to sort or segregate each container from the main path. The pins function in the manner previously discussed and are located in families of pins as previously discussed, also. The pins, however, (see FIG. 7) include an outer surface which is elongated in the direction away from an end part rotationally supported on pin 13, and, within the region near the tip, enlarged axially to provide a bearing surface or active part 20' of convex outline. Looking at the pins along a direction radially inward toward turret 32, the outer surface of each pin appears L-shaped and the active surfaces of the successive pins of the families of pins extend beyond an adjacent pin. Therefore, the active surface 20' of each pin will be at the same height at the periphery of the ejecting wheel, and at a height of the base of the container whereat the dimension is a maximum. The active parts 20' form a single belt of active parts in rotation with the ejecting wheel.

Figure 7:
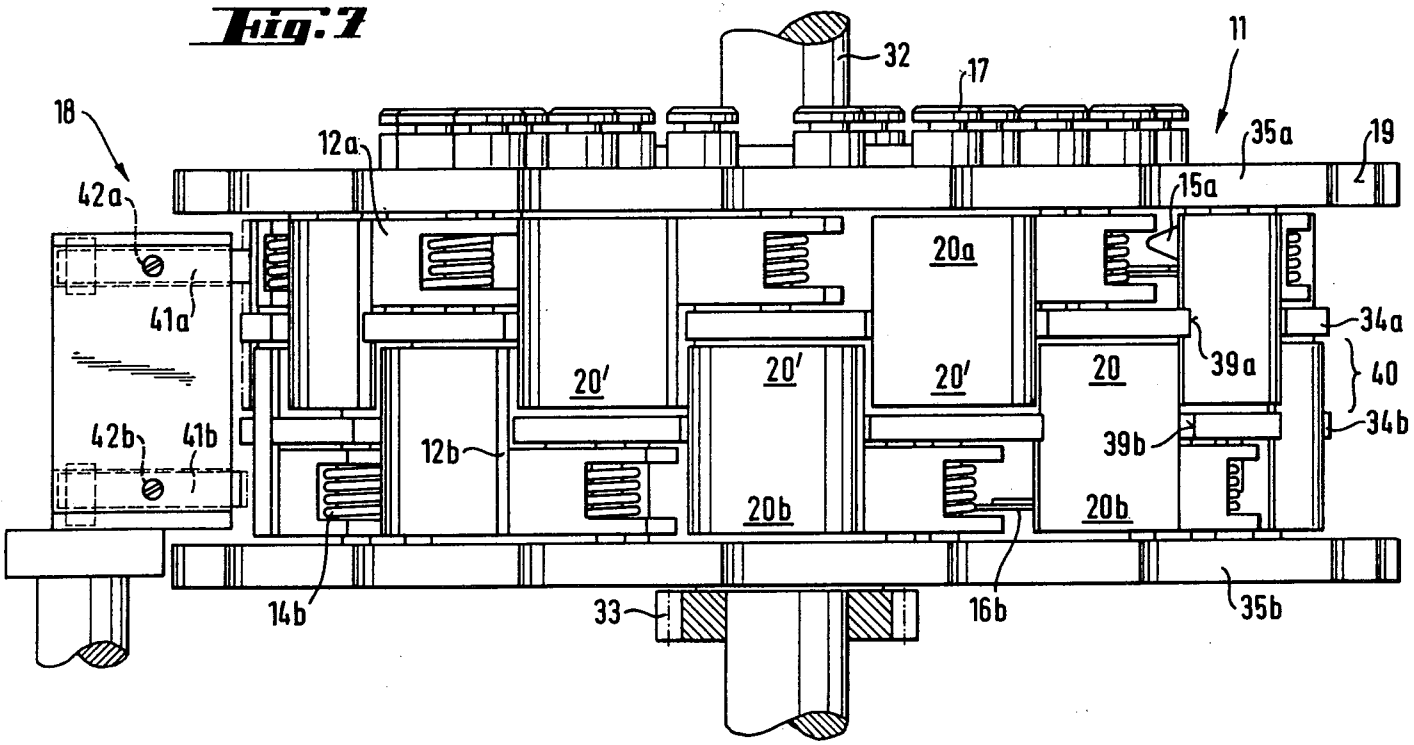
FIG. 7 is a side elevation of the structure of FIG. 6.

Referring to FIG. 7, the ejecting wheel includes a hub 31 and a pair of discs 34*a*, 34*b* between the outer flanges 35*a*, 35*b*. The structure for mounting the pins, for imparting movement to the pins for limiting movement of the pins include, for example, the shaft 13, spring 14, and fixed post 22, all of which structure, as determined by the family of the pin under consideration is carried by the disc 34*a* or 34*b* and the adjacent flange 35*a* or 35*b*. Each of discs 34*a*, 34*b* are cut along their outer peripheries to receive the inner surfaces of the pins opposite the active parts 20'. These cuts are cuts 39*a*, 39*b*.

While the structure of the lugs 15, pawls 16, pushrods 17, switches 28, and so forth, is the same in this form of apparatus, the reset device 18 is somewhat modified. Thus, cam 25 includes a pair of stops 41*a*, 41*b* each acted upon by a spring 42*a*, 42*b*, respectively. When a pin 12, retracted through a substantial angular movement toward the at rest position, strikesa stop 41 it swings further toward the ejecting wheel to a position wherein finger 162 of pawl 16 moves into position, behind shoulder 152 of lug 15. The stop, thus, provides the function of wheel 27. The spring 42 moves the stop to the dot-dash position (FIG. 6) after the ejecting wheel rotates through a few degrees so that a pin that has not been deployed will not strike the stop during rotation of the ejecting wheel. An eccentric cam could be used, as well.

The following table sets out various characteristics of operation.

TABLE

| Examples | No. | 1 | 2 | 3 | 4 |
|---|---|---|---|---|---|
| Types of bottles | Unit | Water | Beer | Fruit juice | |
| Volume | cl | 100 | 35 | 19 | 19 |
| Diameter | mm | 85 | 66 | 59 | 59 |
| Distributing wheel 3 | | | | | |
| Base diameter (circle D) | mm | 690 | 680 | 735 | 735 |
| Number of distributing stations | | 24 | 30 | 36 | 36 |
| Spacing angle | ° | 15 | 12 | 10 | 10 |
| Ejecting wheel 11 | | | | | |
| Useful diameter (circle E) | mm | 260 | 200 | 300 | 200 |
| Number of staggered ejection pins | | 12 | 12 | 18 | 12 |
| Spacing in each row | ° | 60 | 60 | 40 | 60 |
| Wheel base | mm | 520 | 475 | 550 | 498 |
| Ratio of angular speeds | | 2 | 2.5 | 2 | 3 |

The table above illustrates that the data of column 4 corresponds to the joint use of the distributing wheel of column 3 and the ejecting wheel of column 2. The ejecting wheel may comprise a smooth outer periphery whose speed of rotation was increased slightly to introduce sliding on the order of 7%.

I claim:

1. Apparatus for sorting continuously any objects as determined by process criteria from a succession of objects and preventing each sorted object from entry with non-sorted objects to a main path of movement, comprising a distributor including a distributing wheel movable rotationally about a vertical axis for moving all objects along a second path, an element at the end of said second path for urging each object during movement with said distribution wheel toward said main path, an ejecting wheel likewise supported for movement rotationally about an axis parallel to said first-mentioned axis, a plurality of pins, each having an elongated length, carried by said ejecting wheel, said ejecting wheel being synchronized in movement so that said pins in succession when deployed in operation are adapted to act along their length upon successive objects moving with said distributing wheel along said second path between said ejecting and distributing wheels for overcoming action of said element whereby each object to be sorted continues movement with said distributing wheel, each elongated length of each said pin having a convex bearing surface toward said path for acting on an object to be sorted, and a shaft equal in number to the number of pins for mounting said pins for sorting deployment, each said shaft being carried by said ejecting wheel downstream in movement of said ejecting wheel.

2. The apparatus of claim 1 wherein said pins are mounted on said ejecting wheel in two families of pins arranged horizontally one above the other, and wherein the pins of one family of pins are interspersed with the pins of the other family so that their elongated lengths effectively overlap.

3. The apparatus of claim 2 wherein said ejecting wheel comprises a hub, a turret for supporting said hub in movement, an annular disc portion extending substantially from said hub mid-region defining an ejection line, and said pins of said two families being mounted on one side or the other of said ejection line.

4. The apparatus of claim 3 wherein each pin includes an axially extending surface to increase the area of said bearing surface, and wherein each pin of each family is mounted so that said axially extending surfaces extend toward said pins of said other family to provide a substantially continuous bearing surface at a mid-region of said ejecting wheel.

5. The apparatus of claim 2 wherein said pins of one family are staggered relative to said pins of the other family at a half pitch relationship.

6. The apparatus of claim 2 including biasing means, said biasing means mounted by said ejecting wheel for acting upon each pin thereby to urge each pin in movement about said mounting shaft, and a latch structure associated with each pin to maintain said pins in a passive at rest position until deployed for sorting objects.

7. The apparatus of claim 6 including a reset element for resetting each pin as deployed to said at rest position, said reset element mounted substantially in a fixed position whereby said bearing surface of said pin strikes said reset element during rotation of said ejecting wheel and moves about said shaft in a direction of movement opposite to movement when said pin is deployed.

8. The apparatus of claim 7 wherein said reset element compriscs a cam element, which is moved into an advanced position, when it is engaged by a deployed pin.

9. The apparatus of claim 1, wherein said element for urging each object toward said main path comprises a biased semipositive switch.

* * * * *